US005409223A

United States Patent [19]

Attaya

[11] Patent Number: 5,409,223

[45] Date of Patent: Apr. 25, 1995

[54] MAZE

[76] Inventor: Samuel D. Attaya, 41 W. Torch Pine, The Woodlands, Tex. 77381

[21] Appl. No.: 250,905

[22] Filed: Jun. 22, 1994

[51] Int. Cl.[6] ..... A63F 7/04

[52] U.S. Cl. ..... 273/109; 273/118 R

[58] Field of Search ..... 273/153 R, 108, 109, 273/118 R, 113, 117

[56] References Cited

U.S. PATENT DOCUMENTS

| | | | |
|---|---|---|---|
| 3,540,731 | 11/1970 | Muncey | 273/109 |
| 3,787,054 | 1/1974 | Stafford | 273/109 |
| 4,861,036 | 8/1989 | Watanabe | 273/109 X |
| 5,145,174 | 9/1992 | Caramanoff | 273/109 |
| 5,314,181 | 5/1994 | Lin | 273/109 |

FOREIGN PATENT DOCUMENTS

| | | | |
|---|---|---|---|
| 1433257 | 12/1966 | France | 273/109 |

*Primary Examiner*—William E. Stoll
*Attorney, Agent, or Firm*—Guy McClung

[57] ABSTRACT

A hand-held maze unit containing a user-defined maze path and a marble. The top of the maze unit is covered so that the user relies upon verbal instructions provided by a second party who is familiar with or has recorded the internal maze path as to the direction in which to tip or tilt the entire unit so that the marble follows the correct path to a predetermined exit.

1 Claim, 3 Drawing Sheets

MAZE

FIELD OF THE INVENTION

This invention relates to mazes and maze-like configurations, such as are used in certain types of games involving the use of marbles or the like, and in which a marble goes from point "A" to point "B" by means of a predesigned maze path.

BACKGROUND OF THE INVENTION

The first maze configurations were built as antechambers to the pyramids. These maze paths produced a very difficult pathway for intruders to invade the holy resting place of a king or high priest inferred within. Most recently, science has used mazes to study the skills of lab animals.

SUMMARY OF THE INVENTION

As the inventor of a simple, hand-held maze unit, I have incorporated some of the key features of mazes as used in the past. However, one of the features which differs from historical uses of mazes is that the user's view of the internal path of the maze is obstructed by means of a top cover. The purpose and challenge of this maze game is to follow the instructions of a second person as to how to tilt or tip the maze box left, right, up or down to allow a marble to successfully follow the maze from start to finish. In one embodiment the present invention discloses a maze with a box having four sides and a bottom, a plurality of grooves for a plurality of maze units, some at right angles to others and a removable opaque cover for the maze.

DESCRIPTION OF CERTAIN PREFERRED EMBODIMENTS

Figure 1:
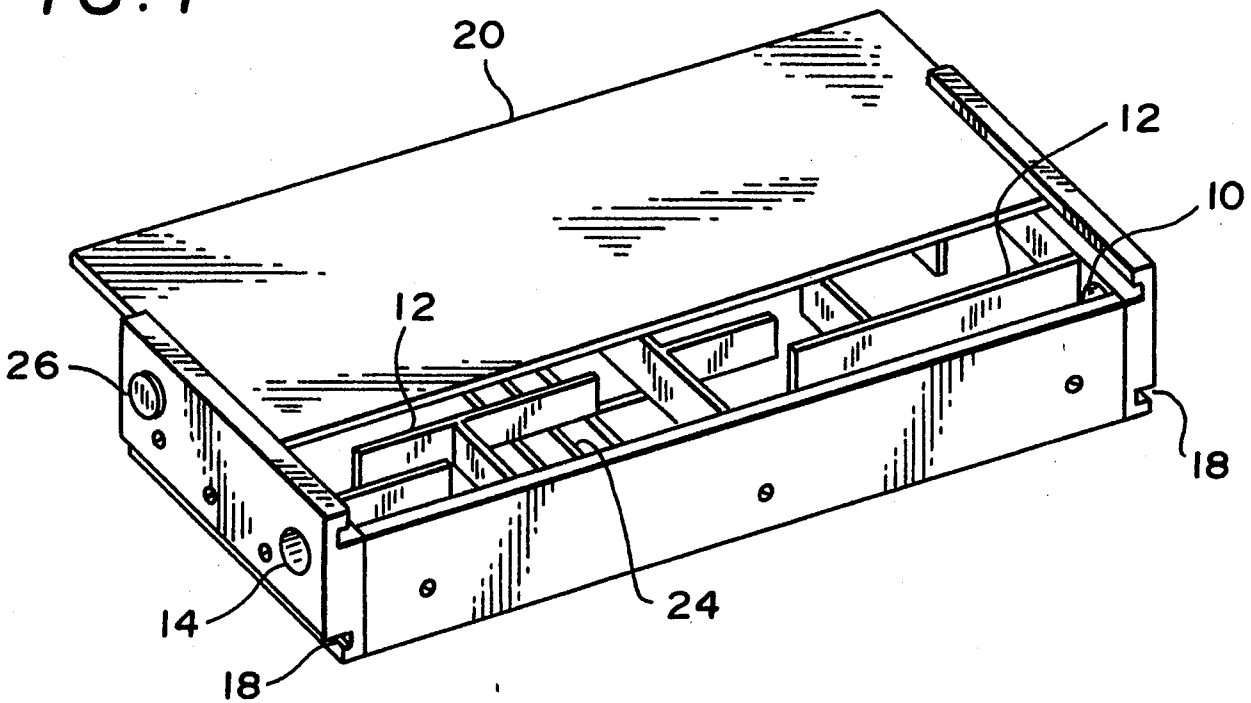
FIG. 1 is a perspective view of a maze according to the present invention.
Figures 2, 3, 4:
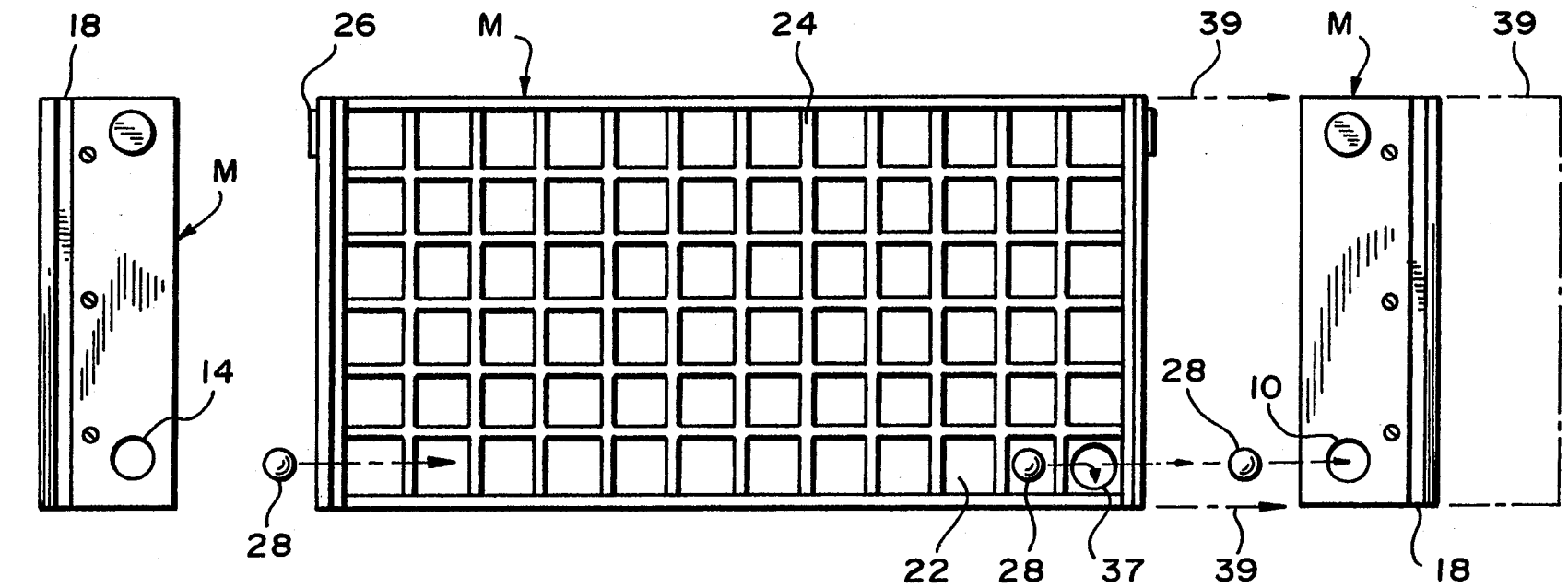
FIG. 2 is an end view of a first end of the maze of FIG. 1.
FIG. 3 is a top plan view of the maze of FIG. 1 with a top cover removed.
FIG. 4 is an end View of a second end of the maze of FIG. 1.

FIGS. 1–4 illustrate a maze unit M according to the present invention with a top cover 20 partially open to reveal maze dividers 12, an entry point of a marble through a hole 14, an exit point 10, and one or more plugs 26 to block holes not used in the given maze configuration. Slots 18 provide attachment for an additional maze unit 39 below the first unit M. A hole 37 is used when two maze units are stacked together so a marble 28 drops through hole 37 to the next lower maze unit 39 (or in another embodiment to another maze box connected in line with the first maze unit M through a hole 10 with the hole 37 plugged).

A plurality of saw cuts or slots 24 extending lower than a plurality of raised portions 22 provide receptacles for receiving and holding a portion of a maze divider 12.

Figure 5:
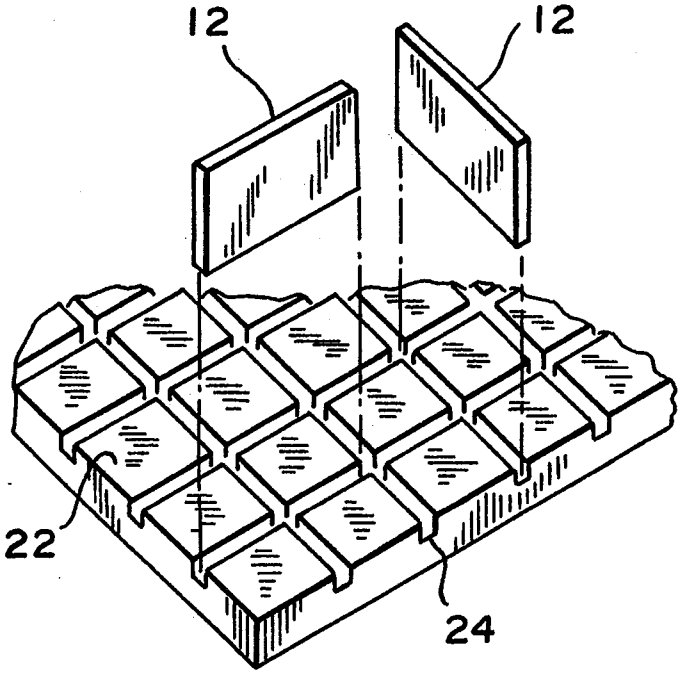
FIG. 5 is a perspective view of a portion of the bottom of the maze of FIG. 1.

FIG. 5 illustrates the ease with which the maze dividers 12 are installed and removed from the slots 24. An assortment of maze dividers 12 of various lengths are supplied with each maze unit so that the maze designer-/user may create a limitless number of maze-path options.

Figure 6:
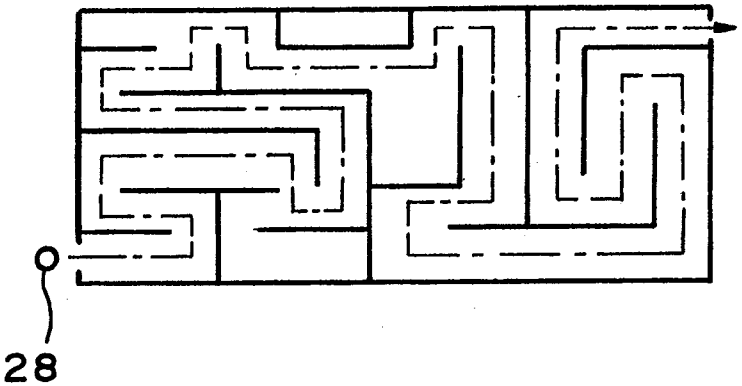
FIG. 6 is a top plan view of a possible maze path for the maze of FIG. 1.

FIG. 6 is a typical maze diagram, illustrating that either the user or the person giving the verbal instructions can easily design his or her own maze with its own maze path.

I claim:

1. A maze unit comprising a box having a bottom, the bottom having a top surface and a first end spaced apart from a second end and a first side spaced apart from a second side, a first end wall extending upwardly from the first end of the bottom, a second end wall extending upwardly from the second end of the bottom, a first side wall extending upwardly from the first side of the bottom and a second side wall extending upwardly from the second side of the bottom, a plurality of slots in the top surface of the bottom, the slots suitable for receiving and releasably holding maze dividers, a plurality of maze dividers removably disposed in the slots and forming a maze path for a marble to follow from the entry point to the exit point, the plurality of maze dividers removable from the slots and re-positionable therein to form a different maze path, the slots including a first series of slots spaced apart from each other and a second series of slots spaced apart from each other, the first series of slots parallel to each other, and the second series of slots parallel to each other and at right angles to the slots of the first series of slots, a marble movable through the maze unit, an opaque cover removably disposed over the box to prevent a person from observing the marble as it moves through the maze unit, and a marble entry point at one location of the box and a marble exit point at another location in the box.

* * * * *